US007785069B2

(12) United States Patent
Spaggiari

(10) Patent No.: US 7,785,069 B2
(45) Date of Patent: Aug. 31, 2010

(54) VENTILATION UNIT

(75) Inventor: Alessandro Spaggiari, Correggio (IT)

(73) Assignee: Spal Automotive S.r.l., Correggio (IT)

( * ) Notice: Subject to any disclaimer, the term of this patent is extended or adjusted under 35 U.S.C. 154(b) by 615 days.

(21) Appl. No.: 11/889,905

(22) Filed: Aug. 17, 2007

(65) Prior Publication Data

US 2008/0050231 A1 Feb. 28, 2008

Related U.S. Application Data

(63) Continuation-in-part of application No. 10/766,520, filed on Jan. 27, 2004, now abandoned, which is a continuation of application No. PCT/IT02/00492, filed on Jul. 26, 2002.

(30) Foreign Application Priority Data

Jul. 27, 2001 (IT) ..... BO2001A0485

(51) Int. Cl.
*F04D 31/00* (2006.01)

(52) U.S. Cl. ..... 416/93 R; 415/169.2

(58) Field of Classification Search ..... 416/93 R, 416/179, 181, 182, 185, 188, 175, 203; 415/106, 415/169.2, 169.3; 417/366, 368, 369; 310/61, 310/62, 63

See application file for complete search history.

(56) References Cited

U.S. PATENT DOCUMENTS 4,150,919 A * 4/1979 Matucheski ..... 416/93 R
4,838,760 A * 6/1989 Brackett ..... 416/93 R

FOREIGN PATENT DOCUMENTS

JP 57024499 A * 2/1982

* cited by examiner

*Primary Examiner*—Richard Edgar
(74) *Attorney, Agent, or Firm*—The Nath Law Group; Jerald L. Meyer; Derek Richmond

(57) ABSTRACT

The ventilation unit has an electric motor, the output shaft of which is fitted with a fan having a cup-shaped central body and a number of blades. The central body is defined by a base wall, and by an annular wall from whose outer face the blades extend. And the main characteristic of the present inventive subject matter lies in through windows being formed in the annular wall of the central body to channel out, in use, any condensate formed inside the central body.

4 Claims, 4 Drawing Sheets

VENTILATION UNIT

This is a continuation-in-part of U.S. patent application Ser. No. 10/766,520, filed on Jan. 27, 2004, now abandoned which is a continuation of PCT/IT02/00492, filed on Jul. 26, 2002, which claims priority from Italian patent application No. BO2001A 000485, filed Jul. 27, 2001, which are all incorporated herein by reference.

FIELD OF THE INVENTIVE SUBJECT MATTER

The present inventive subject matter relates to a ventilation unit, in particular, but not exclusively, for on-vehicle devices such as radiators, heat exchangers, etc.

BACKGROUND

As is known, ventilation units substantially comprise a fan defined by a cup-shaped central body having a base wall and a cylindrical lateral wall, and by a number of blades extending substantially radially from the outer face of the lateral wall; and the central body is fitted to the output shaft of an electric motor housed at least partly in the central body.

One of the main problems of ventilation units of the above type is the formation, inside the central body, of condensate which must be channeled out of the unit. At present, this is done by forming through holes in the base wall of the central body. In actual fact, however, the problem is only partly solved on account of most of the condensate, as opposed to being channeled out of the unit through the holes, being spun by the fan onto the inner face of the lateral wall of the central body. Most of the condensate therefore remains inside the central body and, when the fan is off, may flow towards the electric motor which, as is known, has metal parts and electric circuits which are easily damaged by contact with liquid and/or steam.

Moreover, the ventilation unit may be installed inside or outside the vehicle, in which latter case, the through holes further endanger operation of the electric motor by also channeling rainwater towards it.

SUMMARY OF THE INVENTIVE SUBJECT MATTER

It is therefore an object of the present inventive subject matter to provide a ventilation unit designed to eliminate the aforementioned drawback by means of relatively straightforward, low-cost structural features.

According to the present inventive subject matter, there is provided a ventilation unit of the type comprising an electric motor, the output shaft of which is fitted with a fan having a cup-shaped central body and a number of blades; said central body being defined by a base wall, and by an annular wall from whose outer face said blades extend; and said ventilation unit being characterized in that at least one through window is formed in said annular wall to channel out, in use, any condensate formed inside said central body.

BRIEF DESCRIPTION OF THE DRAWINGS

A non-limiting embodiment of the present inventive subject matter will be described by way of example with reference to the accompanying drawings, in which.

DETAILED DESCRIPTION

The word "exemplary" is used herein to mean "serving as an example, instance, or illustration." Any embodiment described herein as "exemplary" is not necessarily to be construed as preferred or advantageous over other embodiments.

Figure 1:
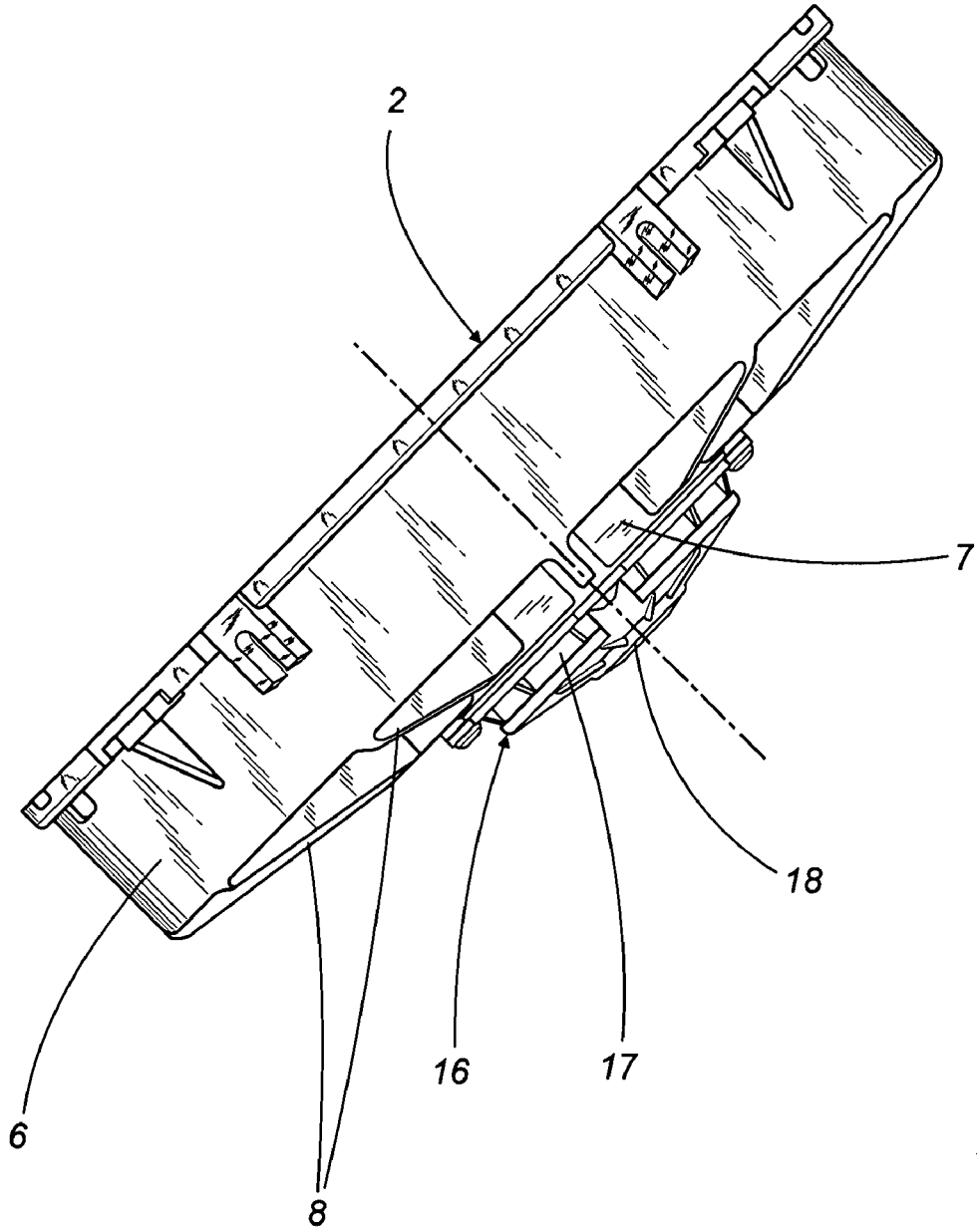
FIG. 1 shows a side view of a ventilation unit in accordance with the teachings of the present inventive subject matter.
Figure 2:
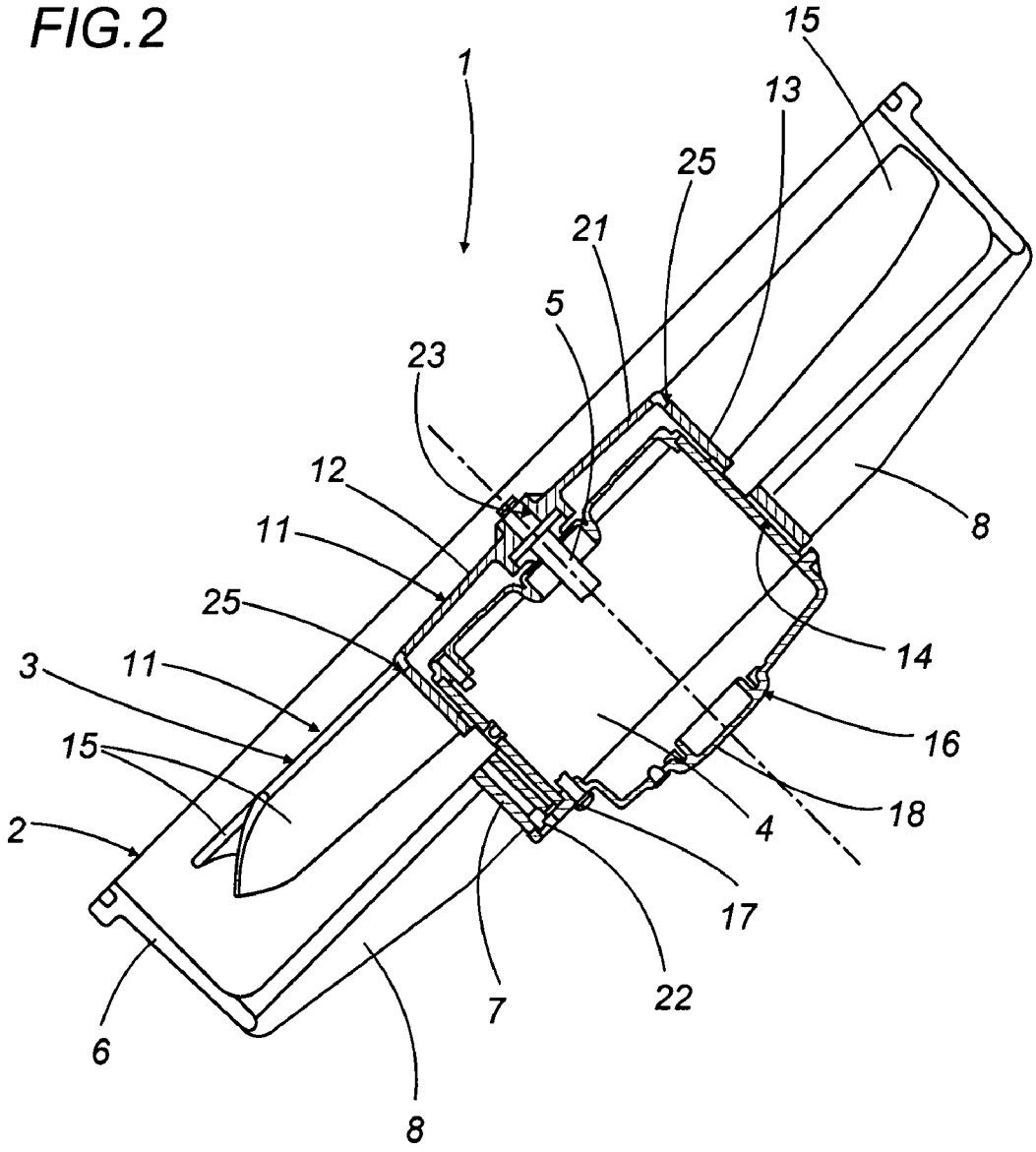
FIG. 2 shows a diametrical section of the FIG. 1 ventilation unit.

With reference to FIGS. 1 and 2, number 1 indicates as a whole a ventilation unit installed at on-vehicle devices (not shown) such as radiators and heat exchangers, or at other temperature-regulating devices, and which, as is known, is substantially used to disperse into the environment the heat produced by such devices.

Ventilation unit 1 comprises a frame 2 fitted integrally to a fixed structure (not shown) on the vehicle; a fan 3 installed inside frame 2; and an electric motor 4, the casing of which is integral with frame 2, and the output shaft 5 of which is fitted with fan 3.

With reference to FIGS. 1 and 2, frame 2 comprises an annular wall 6; a central sleeve 7 coaxial with annular wall 6; and a number of equally spaced radial ribs 8 connecting the outer face of sleeve 7 to the inner face of annular wall 6. More specifically, sleeve 7 and ribs 8 are formed at an axial end edge of annular wall 6; in fact, almost the whole length of sleeve 7 extends axially outside the space enclosed by annular wall 6.

Figure 3:
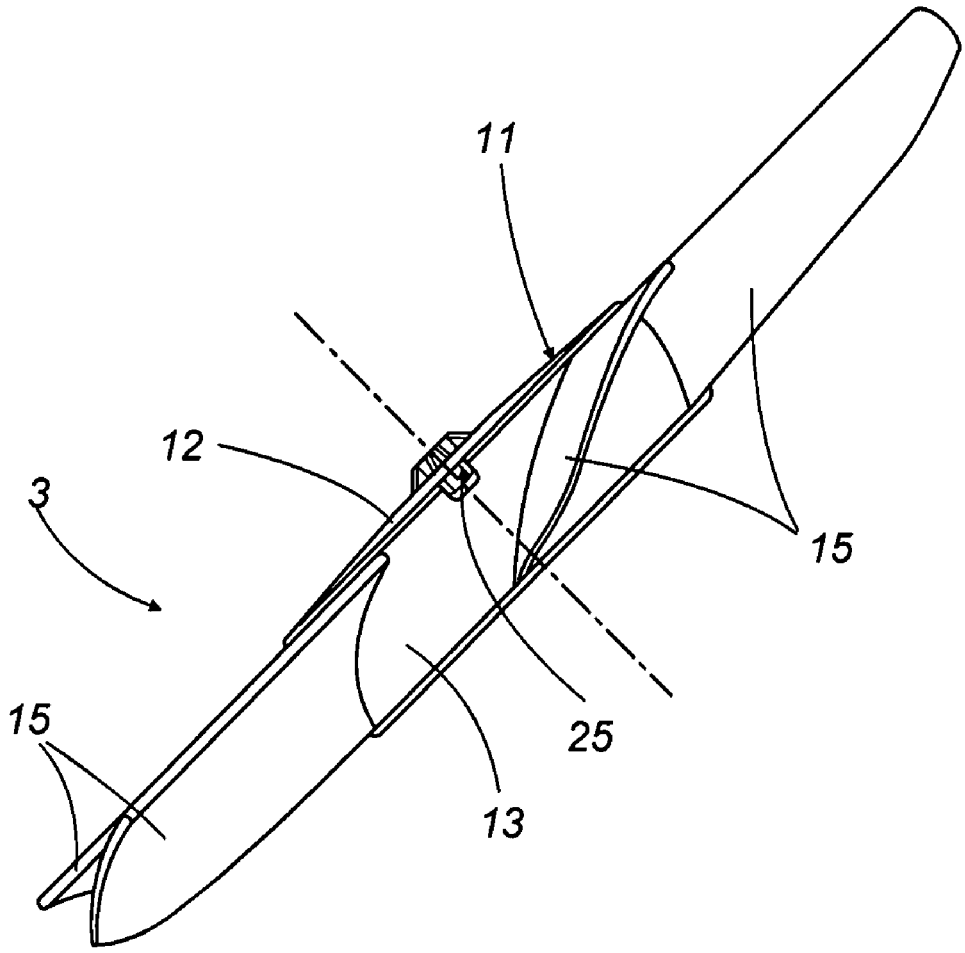
FIGS. 3 and 4 show a side view and plan view, respectively, of a fan of the FIG. 1 ventilation unit.
Figure 4:
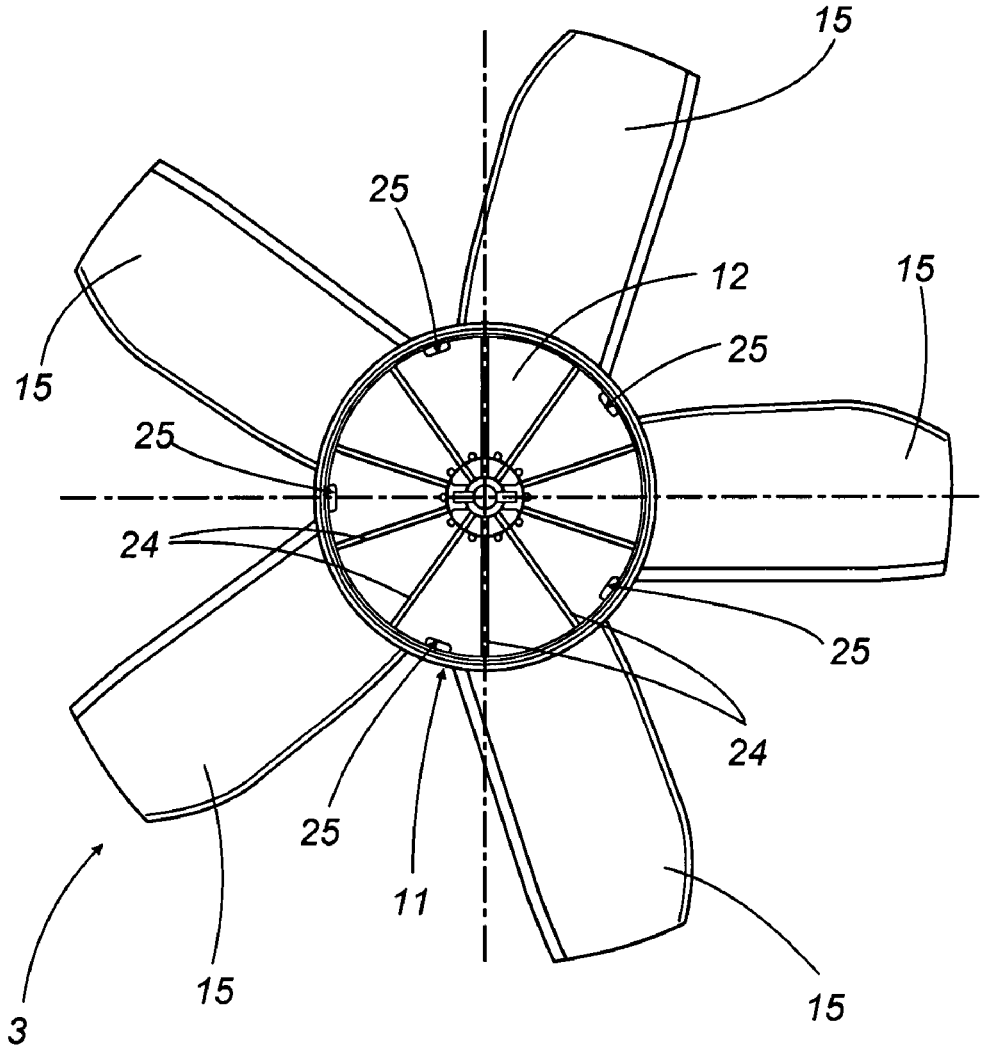

With reference to FIGS. 3 and 4, fan 3 comprises a cup-shaped central body 11 coaxial with sleeve 7 and with annular wall 6 of frame 2, and which comprises a base wall 12, and an annular wall 13 extending firm base wall 12 towards sleeve 7. Central body 11 and sleeve 7 have substantially the same inside diameter, and define a seat 14 (FIG. 2) for housing electric motor 4; and fan 3 also comprises a number of equally spaced blades 15 extending from the outer face of annular wall 13 towards the inner face of annular wall 6.

With reference to FIG. 2, electric motor 4 is installed inside a cylindrical casing 16 defined by an annular lateral wall 17 and by two axial end covers 18 and 21; casing 16 is fixed by screws 22 to sleeve 7; shaft 5 extends outwards of casing 16 through cover 21; and the axial end portion of shaft 5 is fitted with central body 11. More specifically, a through hole 23 is formed in the central portion of base wall 12, and is engaged integrally by said axial end portion of shaft 5; said central portion is thicker than the rest of base wall 12; and equally spaced reinforcing ribs 24 (FIG. 4) are formed between said central portion and the inner face of annular wall 13. Although FIG. 2 shows the motor 4 in cross section, a person having ordinary skill in the art will understand that the casing of motor 4 is solid walled and impermeable to condensate to aid in prolonging the motor's life. The motor 4 has a solid-walled cylinder casing, which is open on each end, a cup-like casing, which is closed on one end of the casing, or a completely closed casing, which is shut off from the surrounding atmosphere so that condensate and/or air cannot enter the motor and cause damage to it. One of the advantages to having a cup-like motor casing, where the motor casing is closed on only one end, is that the open end can still allow the surrounding atmosphere to cool the motor's interior. Of course, the motor casing opening should be faced in the direction downstream of fluid flowing through the ventilation unit.

With reference to FIGS. 2, 3 and 4, through windows 25 are formed in annular wall 13 of central body 11, close to the peripheral edge of base wall 12. In actual use, condensate is channeled out of ventilation unit 1 through windows 25, which are equally spaced and, in particular, each formed in the gap between two adjacent blades 15.

The advantages of the present inventive subject matter will be clear from the foregoing description.

In particular, given the centrifugal force to which the condensate is subjected by rotation of fan 3, forming windows 25 in annular wall 13 provides for more effectively channeling the condensate outwards. Moreover, when stalled outside the vehicle, ventilation unit 1 is protected against infiltration by rainwater, thus safeguarding electric motor 4 against damage by water and/or steam, and so increasing the working life of electric motor 4, which in fact is the most expensive part of ventilation unit 1.

The previous description of the disclosed embodiments is provided to enable any person skilled in the art to make or use the present inventive subject matter. Various modifications to these embodiments will be readily apparent to those skilled in the art, and the generic principles defined herein may be applied to other embodiments without departing from the spirit or scope of the inventive subject matter. For example, one or more elements can be rearranged and/or combined, or additional elements may be added. Thus, the present inventive subject matter is not intended to be limited to the embodiments shown herein but is to be accorded the widest scope consistent with the principles and novel features disclosed herein.

I claim:

1. A ventilation unit comprising:

an electric motor having a solid walled casing and an output shaft fitted with a fan having a cup-shad central body and a number of blades;

said central body being defined by a base wall and by an annular wall extending from and connecting with the base wall;

said base wall being substantially continuously solid and having a central portion which is thicker than the rest of the base wall;

said annular wall having an inner face and an outer face, the number of blades extending from the outer face; and a number of reinforcing ribs having opposing ends formed to connect at one end to the central portion of the base wall and to connect at another end to the inner face of the annular wall;

wherein a number of through windows are formed in the annular wall portion of said central body, and at peripheral edges where the base wall and the annular wall connect, each placed in the gap between two adjacent blades and between two adjacent reinforcing ribs to channel out any condensate formed inside said central body.

2. A ventilation unit as claimed in claim 1, characterized in that said number of blades are equally spaced.

3. A ventilation unit as claimed in claim 1, characterized in that said number of reinforcing ribs are equally spaced.

4. A ventilation unit as claimed in claim 1, characterized in that said number of through windows formed in said annular wall are equally spaced.

* * * * *

UNITED STATES PATENT AND TRADEMARK OFFICE

CERTIFICATE OF CORRECTION

PATENT NO. : 7,785,069 B2
APPLICATION NO. : 11/889905
DATED : August 31, 2010
INVENTOR(S) : Alessandro Spaggiari It is certified that error appears in the above-identified patent and that said Letters Patent is hereby corrected as shown below:

In the Claims:

Column 3, Claim 1, Line 28
Please delete "cup-shad"
and replace with -- cup-shaped --

Signed and Sealed this

Twenty-sixth Day of October, 2010

David J. Kappos

David J. Kappos
*Director of the United States Patent and Trademark Office*